US005283502A

United States Patent [19]

Piasuowski et al.

[11] Patent Number: 5,283,502

[45] Date of Patent: Feb. 1, 1994

[54] METHOD AND CIRCUIT FOR SQUARE WAVE CURRENT GENERATION BY HARMONIC INJECTION

[76] Inventors: Andrew D. Piasuowski, 535 Chaline, St. Lazare, Quebec, Canada, J0P 1V0; Vladimir Glavac, 25 19th Avenue, Pincourt, Quebec J7V 5A4, Canada

[21] Appl. No.: 887,985

[22] Filed: May 19, 1992

[51] Int. Cl.[5] ..... H05B 37/00

[52] U.S. Cl. ..... 315/244; 315/247; 315/283; 315/307; 315/DIG. 5; 315/DIG. 7

[58] Field of Search ..... 315/283, 244, 246, 247, 315/DIG. 7, 291, 307, DIG. 5, 289, 290

[56] References Cited

U.S. PATENT DOCUMENTS 4,631,450 12/1986 Lagree et al. ..... 315/244
5,087,861 2/1992 Boyd et al. ..... 315/247
5,121,034 6/1992 Allen et al. ..... 315/246

*Primary Examiner*—Robert J. Pascal
*Assistant Examiner*—Michael B. Shingleton

[57] ABSTRACT

An improved arc discharge ballast is disclosed which comprises harmonic resonators, simple switching means and a drive circuit. The harmonic resonators, switching means and drive circuit are coupled to the lamp to provide squaring of the current waveform and provide even light output. By adding odd harmonic current elements to a lamp driven by a conventional ballast, advantages of even light output or power saving is obtained.

4 Claims, 7 Drawing Sheets

Table 7A

| S1 TO S4 FUNCTION | | | | |
|---|---|---|---|---|
| Condition | S1 | S2 | S3 | S4 |
| $\lvert Vd \rvert \leq Vl$ | Off | Off | Off | Off |
| $\lvert Vd \rvert > Vl$ | Off | On | On | Off |
| $\lvert -Vd \rvert \leq Vl$ | Off | Off | Off | Off |
| $\lvert -Vd \rvert \geq Vl$ | On | Off | Off | On |

METHOD AND CIRCUIT FOR SQUARE WAVE CURRENT GENERATION BY HARMONIC INJECTION

BACKGROUND OF THE INVENTION

This invention relates to an improved ballast circuit for an arc discharge lighting circuit and wherein improved current waveform to the lamp is provided, and particularly but not exclusively to ballasts for supplying power to arc discharge lamps such as for filming, commercial or street lighting. This invention also relates to the method of supplying a substantially square wave current derived from an alternating voltage source to feed an arc discharge lamp circuit.

An arc discharge lamp is a device for producing light output when electrical energy is applied to the connecting electrodes. In equipment used for driving arc lamps, it is well known that iron and copper reactors or electronic ballasts are used for regulating current to the lamp. The iron and copper ballast produces an approximate sine waveform current to the lamp and hence a modulated light output is obtained. Electronic ballasts produce either square wave or quasi sinusoidal current waveforms of varying frequencies, depending on the application, and often do not exhibit light modulation.

An advantage of electronic ballasts over conventional ballasts is that they often provide more power efficient operation of the lamp for a given power input. However, the high cost and lower reliability of electronic ballasts has limited application and usage.

SUMMARY OF THE INVENTION

It is feature of the present invention to provide an improved ballast circuit for supplying a substantially square wave current derived from an alternating voltage source to feed an arc discharge lamp circuit and wherein the square wave current is derived by combining the natural frequency of resonators with the current component of the fundamentals of the alternating voltage source.

Another feature of the present invention is to provide a method of supplying a substantially square wave current derived from an alternating voltage source to feed an arc discharge lamp circuit and wherein a closed loop is formed with one or more harmonic resonators connected across the discharge lamp to combine the natural frequency of the resonators with the current component of the fundamentals of the alternating voltage source.

According to the above features, from a broad aspect, the present invention provides an improved ballast circuit for supplying a substantially square wave current derived from an alternating voltage source to feed an arc discharge lamp circuit. The ballast circuit comprises a conventional ballast connected between the alternating voltage source and the arc discharge lamp circuit. One or more harmonic resonators are connected across the arc discharge lamp circuit. An automatic switching circuit is connected in series with the one or more harmonic resonators. Sensing means is provided to sense the phase of the alternating voltage source and for actuating the switching circuit to activate the one or more resonators to oscillate at their natural frequency to combine with the current component of the fundamentals of the alternating voltage source so as to produce the substantially square wave current whereby an arc discharge lamp in the lamp circuit emits light which is substantially undisturbed.

According to a still further broad aspect of the present invention, there is provided a method of supplying a substantially square wave current derived from an alternating voltage source to feed an arc discharge lamp circuit. The method comprises the steps of feeding the alternating voltage source to the arc lamp discharge circuit through a conventional ballast. A closed loop is formed with one or more harmonic resonators connected across the arc discharge lamp circuit. The resonators oscillate at their natural circuit at their natural frequency to combine with the current component of the fundamentals of the alternating voltage source so as to produce the said substantially square wave current, whereby an arc discharge lamp in the arc discharge lamp circuit emits light which is substantially undisturbed.

BRIEF DESCRIPTION OF THE DRAWINGS

A preferred embodiment of the present invention will now be described with reference to the accompanying drawings in which:

FIG. 7 is a function table to simulate the lamp model;

Before describing the preferred embodiment of the present invention, a reference is made to the prior art illustrated by some of the drawings.

Figure 9A:
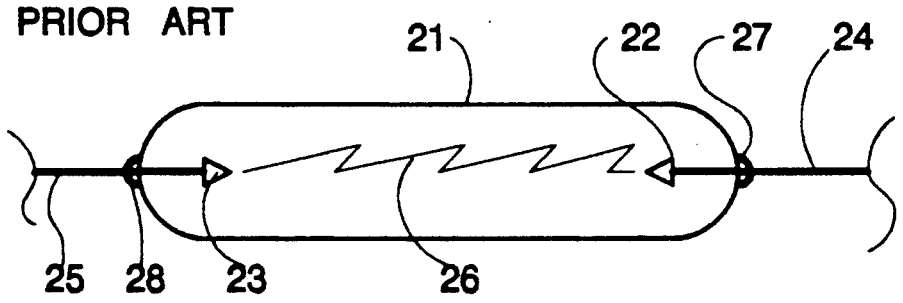
Figure 9A PRIOR ART
FIG. 9A is a simple model for describing an arc lamp.

FIG. 9A shows a typical construction of an arc lamp. It is usually comprised of an enclosed vessel 21 made from a transparent material such as glass or optical quartz. The vessel may contain a single gas, a mixture of gases and/or a combination of gases and solids such as rare earth elements. The contents inside the vessel constitute a path for an electrical discharge to pass through.

Electrodes 22 and 23 provide means by which the electrical discharge can pass into the gas/solid mixture.

Connecting leads 24 and 25 provide means by which an external electrical source can be provided to the electrodes. The connecting leads pass through airtight seals 27 and 28.

Usually, when the lamp is unused and cold, the mixture inside the lamp is non-conductive to the passage of electricity, and to start electrical conduction in the lamp a very high voltage has to be applied to start the lamp. The high voltage is known as ionization potential and is usually provided by an ignitor.

Once the lamp is able to conduct electricity, the mixture inside the vessel provides a very easy path for the discharge. The path is usually of such low resistance that external means have to be provided to limit the current through the lamp.

The passage of electrical current through the medium inside the vessel may cause a heating effect which is usually beneficial to the operation of the lamp and the various constituents are active in the production of light due to the passage of the current.

Arc lamps have the advantage over incandescent lamps because they are usually more efficient.

Figure 9B:
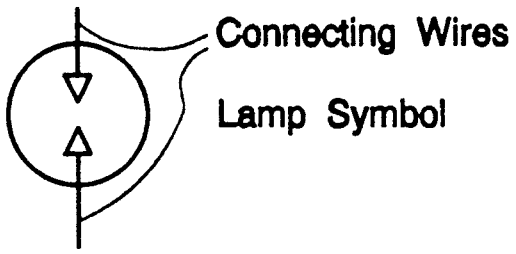
Figure 9B PRIOR ART
FIG. 9B is an electrical symbol of the said arc lamp.

FIG. 9B is an electrical symbol depicting the lamp shown in FIG. 9A.

Due to the very low resistive nature of the arc lamp, a means has to be normally provided to limit the current in the lamp. For lamps that operate from the domestic and industrial power supplies, which are alternating voltage sources, (an example being given in FIG. 10), the simplest and cheapest method of limiting current is by means of a ballast or reactor placed in series with the lamp and the supply.

The ballast which is sometimes known as a reactor is an inductive element which provides an impedance to the alternating current flowing through the lamp.

The design and manufacture of ballasts and reactors is a well known art and the extensive use of these devices is found in street lighting, fluorescent lighting and many other applications.

Ballasts used for supplying arc lamps are well known, in which iron and copper construction is very common. However, although the art of ballast manufacture is well practiced, they do provide characteristics in the arc lamps which are undesirable especially in film and video applications.

These undesirable characteristics will be described in more detail.

Figure 1:
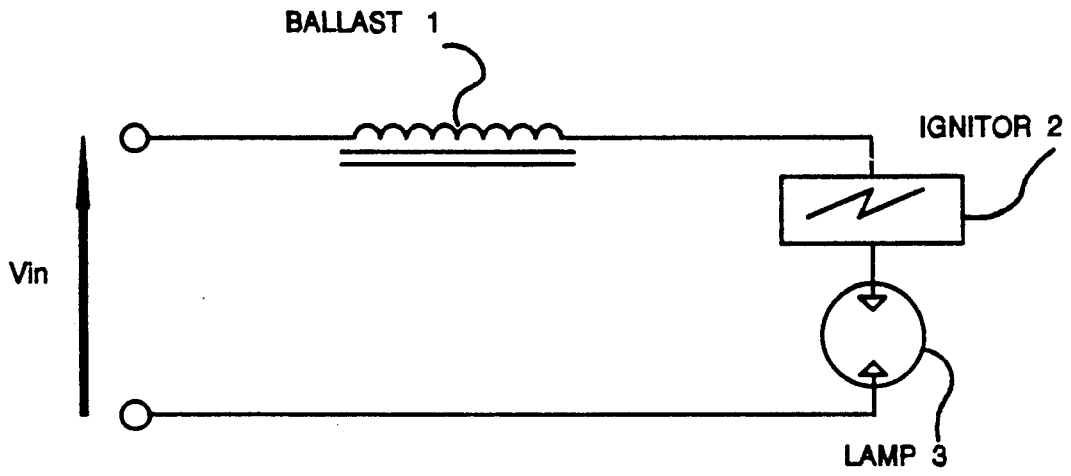
Figure 1 PRIOR ART
FIG. 1 is a simplified circuit of a conventional ballast.

FIG. 1 illustrates a typical circuit for a conventional ballast. Input voltage $V_{in}$ may be obtained straight from the supply via a protection circuit, (e.g. fuses or circuit breakers), or may be obtained via an auto transformer which is a common occurrence.

Ballast 1 is essentially connected in series with an ignitor 2 and lamp 3. The ignitor 2 is sometimes required to initiate operation of the lamp as described previously. However, in the case of fluorescent ballasts, starting may be initiated by a transformer capacitor arrangement known as semi-resonant start (SRS).

Figures 2A, 2B:
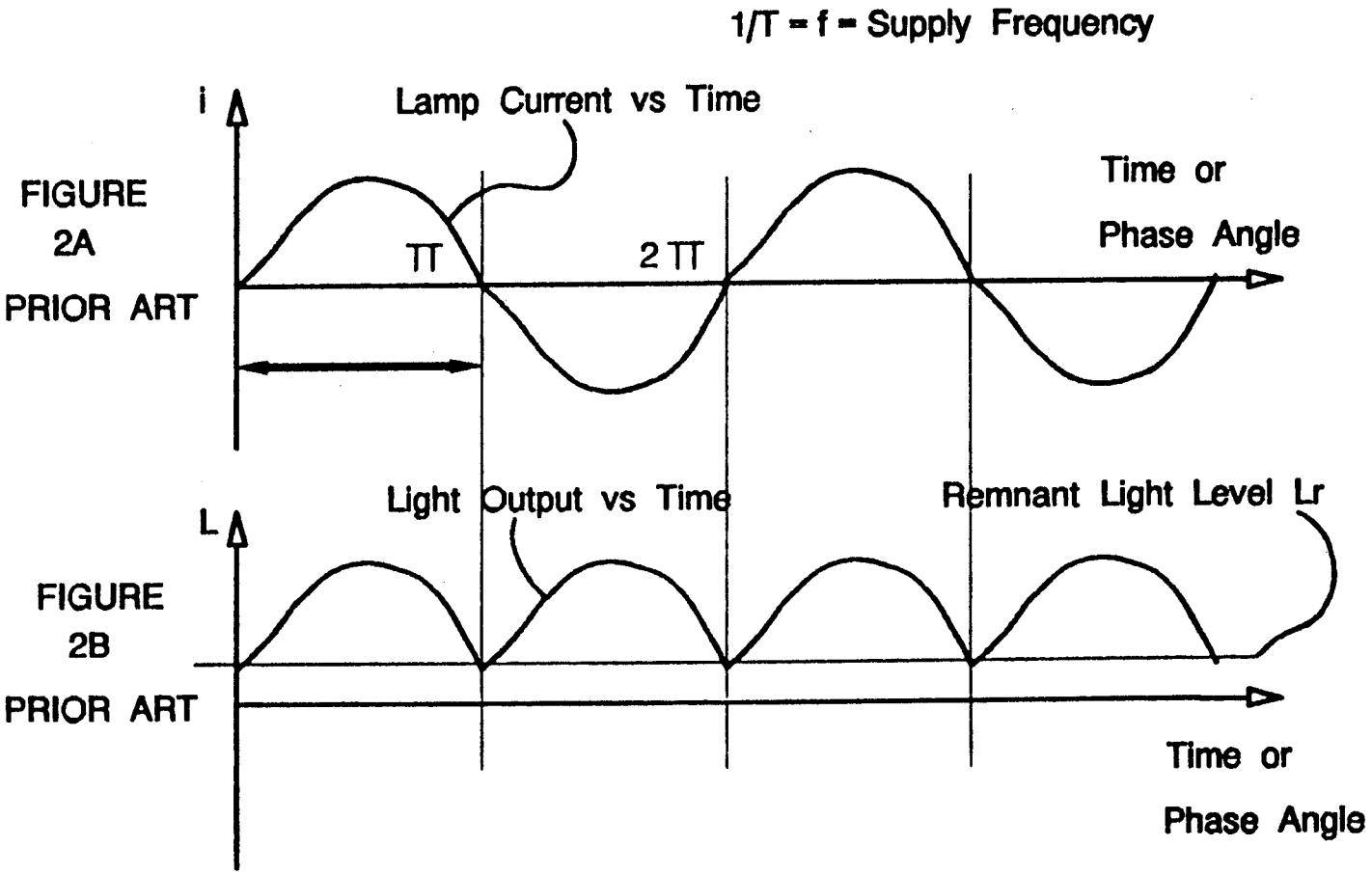
FIGURE 2A PRIOR ART
FIGURE 2B PRIOR ART
FIG. 2A shows the lamp current waveform of a conventional ballast.
FIG. 2B shows the light output of a conventional ballast.

FIG. 2A shows the typical current which would flow through the lamp 3 and is usually of approximate sinusoidal form.

The light output obtained from an arc lamp is related to current and can be represented approximately by:

$$l_i = K_1 \cdot i_1^{K_2} + l_r \quad (1)$$

where $l_i$ = light input $K_1$ and $K_2$ lamp constants $i_1$ = lamp current $l_r$ = remnant light.

FIG. 2B shows that light output is modulated in sympathy to the supply frequency. The fact that the light output does not fall to zero is due to energy being released by the constituents of the lamp even through the current may be zero. This phenomena is exhibited by many type of lamps and particularly fluorescent lamps and high pressure metal halide lamps.

To overcome the light modulation problem, electronic ballasts have been developed. Electronic ballasts are an arrangement of electronic and magnetic components akin to the art of switched mode power supplies and is well known. The operating frequency of the lamp is raised above the supply frequency such that the described light modulation is not perceptive. If the frequency is raised for example to 30 KHz, the light output becomes very even due to the remnant effect of the lamp.

Alternatively electronic ballasts can be designed to provide square wave current to the lamp. In this embodiment even light output is obtained.

Figure 3A:
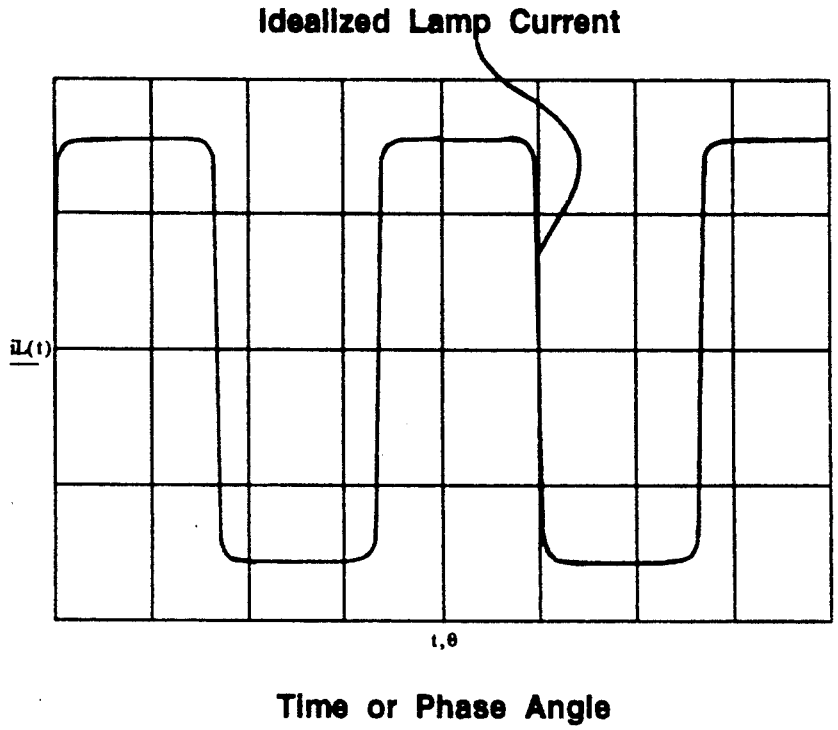
Figure 3A PRIOR ART
FIG. 3A shows the lamp current waveform of a conventional ballast.

FIG. 3A demonstrates a preferred lamp current waveform for improved performance where $i_1$ is of square waveform.

Figure 3B:
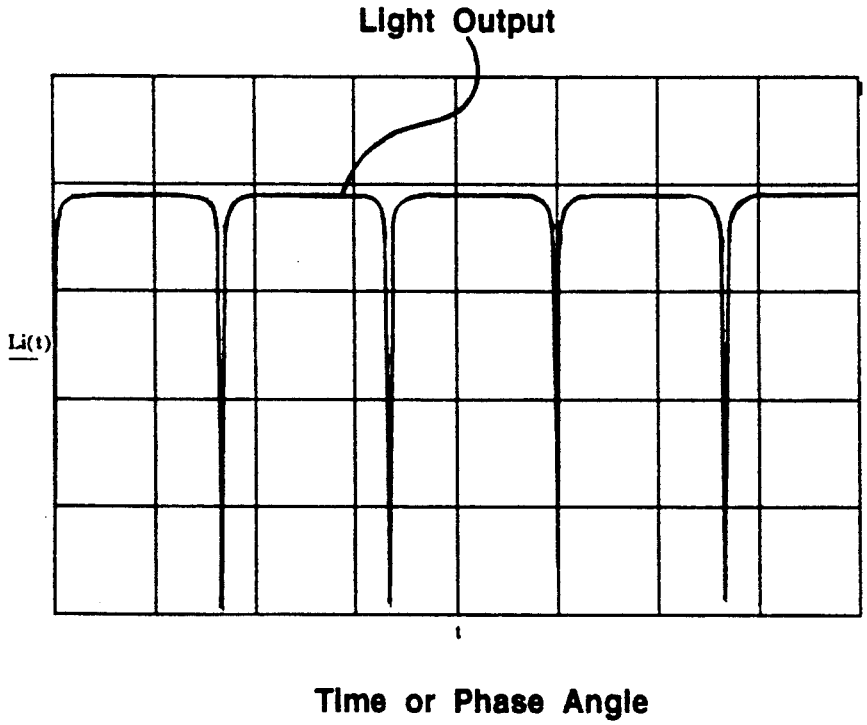
Figure 3B PRIOR ART
FIG. 3B shows the lamp light output when an ideal waveform is applied.

FIG. 3B shows the light output of a lamp in which current waveform depicted in FIG. 3A flows. The resultant light output is steady.

The disadvantages of electronic ballasts are relatively expensive and unreliable when compared to standard ballasts as described.

A further disadvantage of electronic ballasts is that they are electrically and acoustically noisy compared to the conventional ballast.

Electronic ballasts are essentially power supplies which regulate current to the lamp.

PREFERRED EMBODIMENT OF THE INVENTION

We have found that these disadvantages may be overcome by converting a conventional ballast to almost square wave operation.

FIGS. 1, 2 and 9 show the characteristics of prior art ballasts and corresponding light output.

FIG. 3 shows the effect of an idealized waveform for an arc lamp and has been described.

FIGS. 4, 5, 6, 7 and 8 show the embodiment of the invention.

Since square waveforms can be represented by a Fourier Series, we have found that by modifying the Fourier coefficients and injecting mainly the third and fifth harmonic current components, an approximately square current is obtained.

A Fourier series is a mathematical expression describing a time variable fluctuation.

A Fourier series is particularly useful in describing repetitive waveforms which appear to be discontinuous. A square waveform for example appears to be discontinuous since the output remains steady and then after an interval changes abruptly in sign.

A Fourier series is a series of time dependent harmonics and their coefficients, and when a sum is taken at an instant in time the value will correspond directly to the waveform the series represents.

In the case of a square waveform of unit magnitude, the Fourier series representing this waveform would be as follows:

$$i = \quad (2)$$

-continued $$i_{pk} * \frac{\pi}{4} * (\text{Sin}\omega t + \frac{1}{3}\text{Sin}3\omega t + \frac{1}{5}\text{Sin}5\omega t + \frac{1}{7}\text{Sin}7\omega t + \ldots$$

This equation represents the current waveform as shown in FIG. 3A. If the Fourier series was terminated at the fifth harmonic, the resultant waveform would appear as shown in FIG. 4B.

Figure 4A:
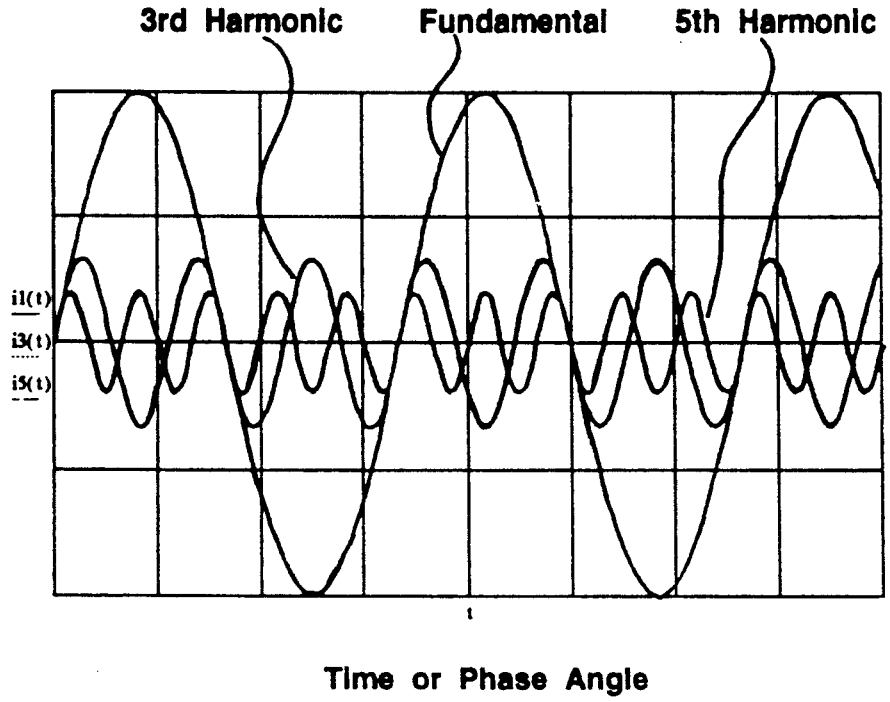
Figure 4A PRIOR ART
FIG. 4A shows the Fourier components of a square waveform up to the fifth harmonic.
Figure 4B:
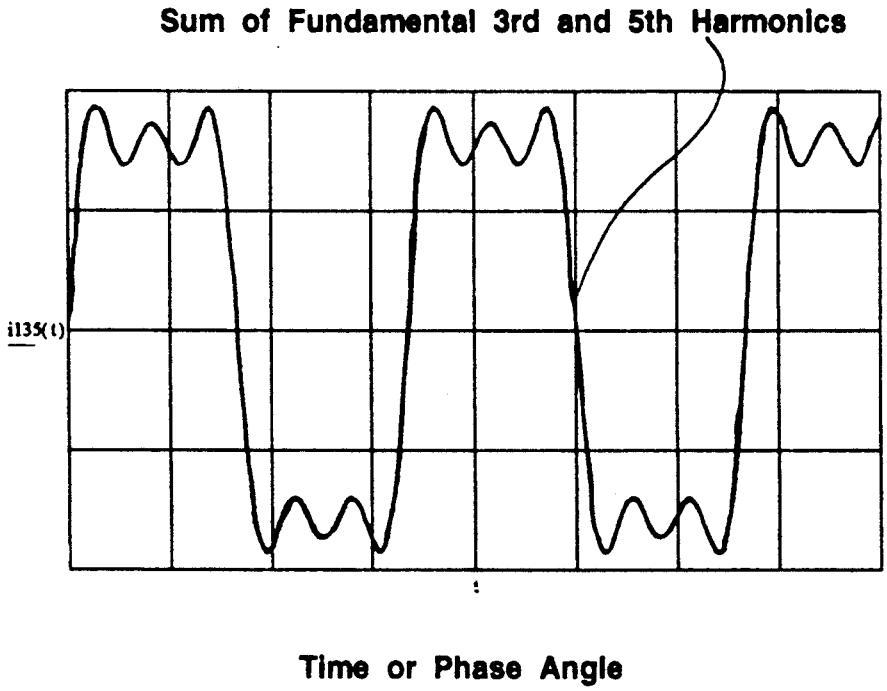
Figure 4B PRIOR ART
FIG. 4B shows the resultant waveform of the Fourier components up to the fifth harmonic.

The component of third and fifth harmonics can be seen in FIG. 4A.

To provide an infinite series of third and higher order harmonics and add to a sinusoidal fundamental current waveform of a lamp would be very difficult. What we have found by modifying the Fourier coefficients, is what we can obtain a steady light output and need not inject current harmonics higher into the lamp circuit than the fifth harmonic.

Our modified Fourier series is as follows:

$$i_1 = i_{pk} * \frac{\pi}{4} = \left(\text{Sin}\omega t + \frac{1}{4}\text{Sin}3\omega t + \frac{1}{12}\text{sin}5\omega t\right) \quad (3)$$

Figure 5A:
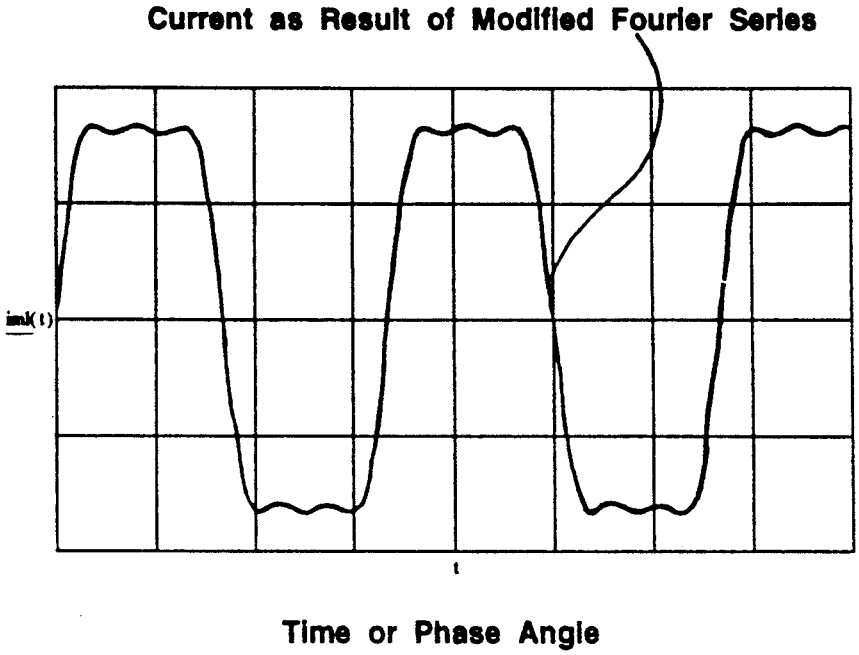
FIG. 5A shows a current waveform of a modified Fourier series.

The resultant lamp current waveform from the above modified series would appear as in FIG. 5A. Due to remnant light flux in certain lamps, it is not necessary to generate a perfect square waveform.

Figure 5B:
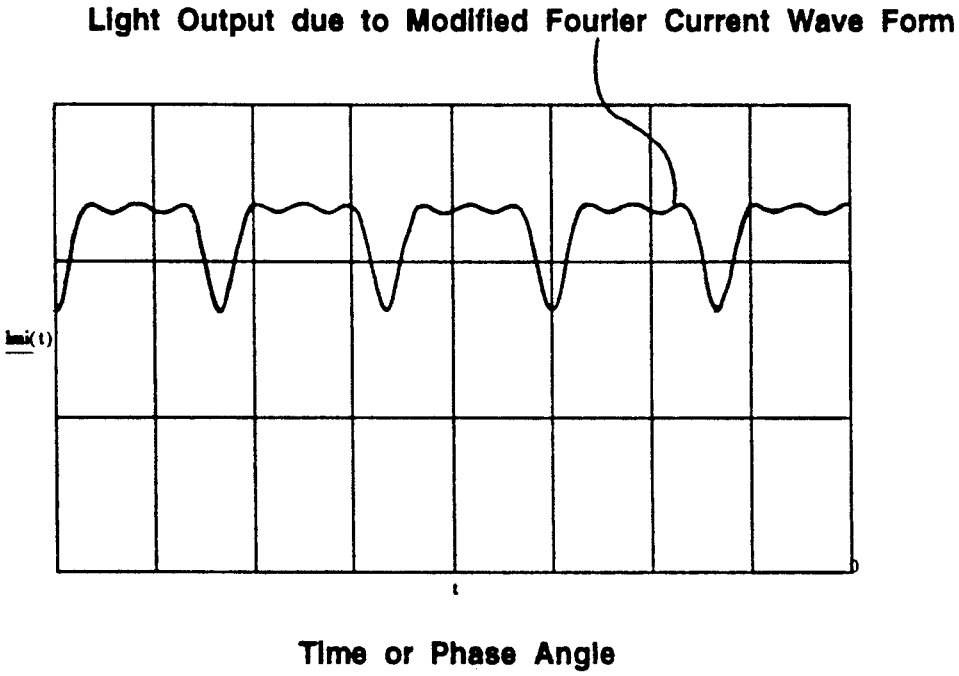
FIG. 5B shows a light output of converted ballast with modified Fourier components.

In this embodiment even light output is obtained and is shown in FIG. 5B.

On certain lamps due to the harmonics more light output is obtained for the same input power to the lamp. Hence for equivalent light output power saving is obtained.

Figure 8:
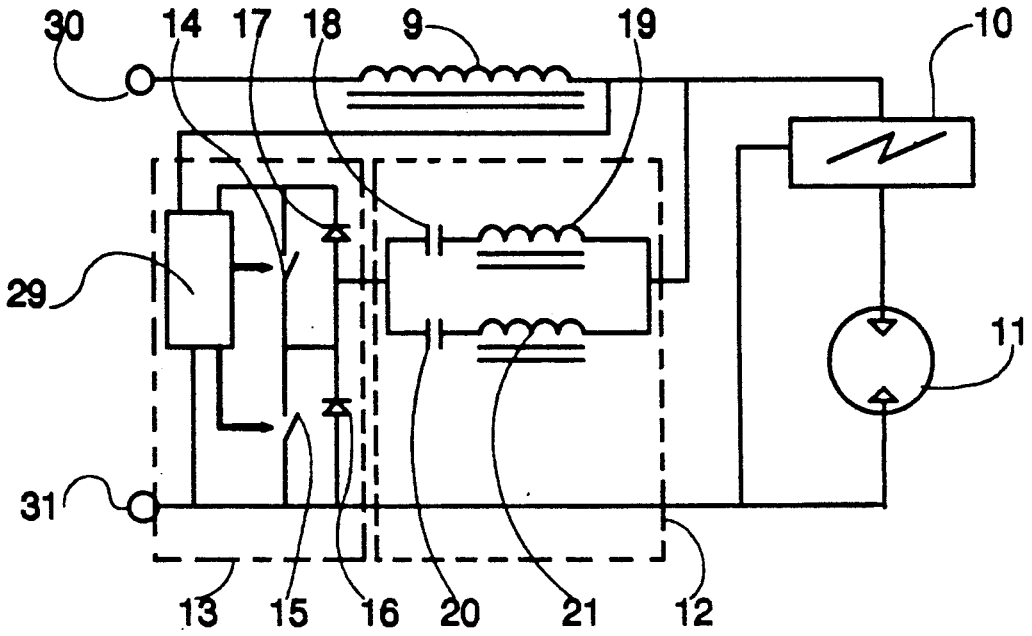
FIG. 8 is a simplified circuit of a modified ballast (preferred embodiment)

The harmonics may, but not necessarily, be generated by harmonic resonator comprised of inductive and capacitive elements coupled to the lamp in the embodiment of modified ballast shown in FIG. 8.

Figure 6:
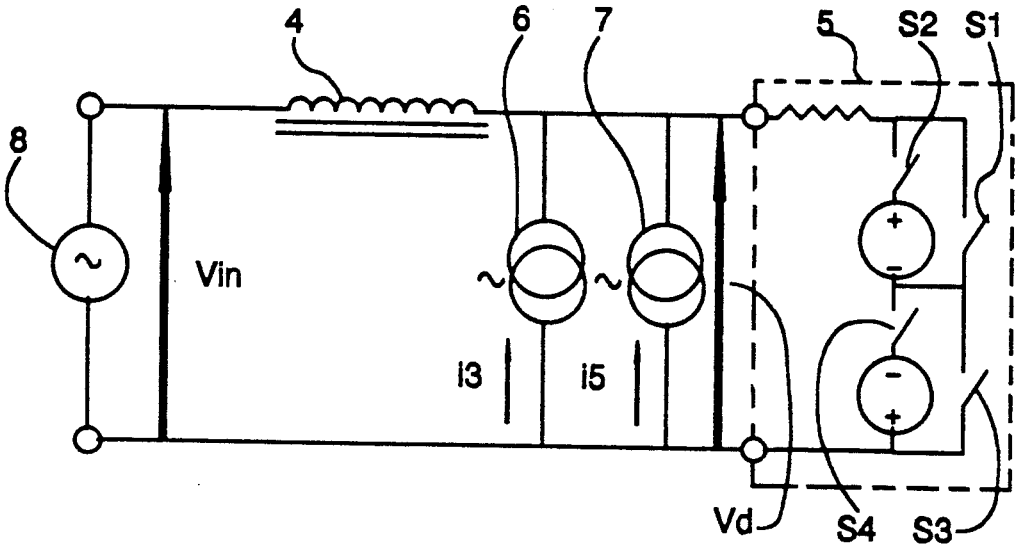
FIG. 6 is a simplified canonical model of a modified ballast.

FIG. 6 illustrates the canonical model of a modified ballast. Input voltage source $V_{in}$ 8, is applied via reactor 1 to a simplified lamp 5 model.

Third harmonic current source 6 and fifth harmonic current source 7 generate harmonic components depicted in equation 3.

Current sources 6 and 7 are connected across the lamp model.

Lamp model 5 may be considered as a constant voltage source, its polarity opposing the applied current can be modeled easily as shown in FIG. 7.

Table 7A shows the switch functions S1 through S4 which models the lamp 5 of FIG. 6.

In the embodiment shown in FIG. 6, a current source 6 generates third harmonic $i_3$ and adds it to the fundamental $i_1$.

In the embodiment shown in FIG. 6, a current source 7 adds fifth harmonic $i_5$ to fundamental current $i_1$. The sum of the currents provides a waveform as depicted in FIG. 5A.

FIG. 8 shows the embodiment of the invention. Block 13 and block 12 comprise the modification to a standard ballast which is an example for implementation of the invention.

Figure 10:
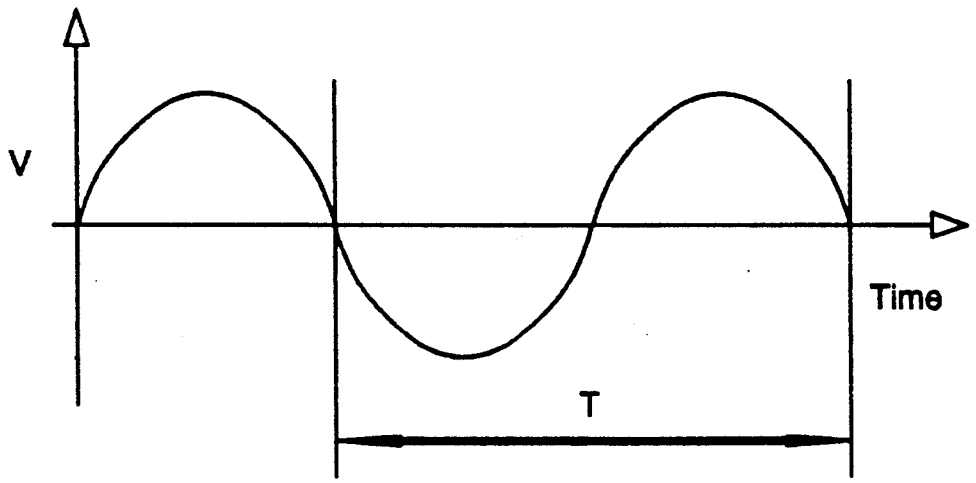
Figure 10 PRIOR ART
FIG. 10 is an example of an alternating voltage source which produces an alternating current (AC) in an external circuit.

A conventional ballast has two power input terminals 30 and 31 to which an alternating power source such as shown in FIG. 10 is connected. Terminal 30 is connected to ballast 9 and to a drive circuit 29. Ballast 9 is also connected to inductor 19 and to ignitor 10. Inductor 19 is part of a harmonic resonator and coupled to capacitor 18 which provides a resonant circuit for one of the required harmonics. Ballast 9 is also connected to inductor 21 which is part of a harmonic resonator. Inductor 21 is coupled to capacitor 20 and forms part of a harmonic resonator and is resonant at a harmonic of the fundamental supply frequency. The ignitor 10 is connected to both sides of lamp 11.

In some cases, the ignitor 10 would not be used due to the low ionization voltage of the lamp, and ballast 9 would be connected directly to the lamp 11. Lamp 11 is connected to switch 16, diode 15, drive circuit 29 and power return terminal 31.

Switch 15 is also connected to switch 14, diode 17 and to the other side of diode 16. The other side of diode 17 is connected to switch 14 and to drive circuit 29. The drive circuit 29 controls switches 14 and 15.

When switch 15 is on, switch 14 is off. When switch 14 is on, switch 15 is off. Switches 15 and 14 turn on and off at the input power supply frequency and are phase shifted in sequence so that the harmonic currents enter the lamp 11 in the correct phase.

In the embodiment shown in FIG. 8, the harmonic resonators for third and higher order harmonics are placed such that they add and substract in the correct phase to the fundamental lamp current. The resonators are comprised of conductors, capacitors and simple semi-conductor networks. The invention can be most usefully applied to filming and video applications where flicker-free lighting is essential.

Another great advantage of the invention is that on certain lamps, e.g., fluorescent and lower pressure sodium, power saving is obtained by utilizing square waveform currents. On some lamps, more light efficacy is obtained by employing peaking current waveforms.

We claim:

1. An improved ballast circuit for supplying a substantially square wave lamp current waveform derived from an alternating voltage source to feed an arc discharge lamp, said ballast circuit comprising a conventional ballast connected between said alternating voltage source and said arc discharge lamp, one or more harmonic resonators connected across said arc discharge lamp, an automatic switching circuit connected in series with said one or more harmonic resonators, sensing means to sense the phase of said alternating voltage source and for actuating said switching circuit to activate said one or more resonators to oscillate at their natural frequency to combine with the current component of the fundamental of said alternating voltage source so as to produce said substantially square wave lamp current waveform whereby said arc discharge lamp can emit light which is substantially undisturbed.

2. An improved ballast circuit as claimed in claim 1, wherein said arc discharge lamp comprises an ignitor circuit connected with said arc discharge lamp.

3. An improved ballast circuit as claimed in claim 1, wherein said light which is substantially undisturbed includes remnant light flux emitted by said lamp.

4. An improved ballast circuit as claimed in claim 1, wherein said harmonic generators comprise a fifth and third harmonic of said alternating voltage source as derived by a modified Fourier mathematical series.

* * * * *